United States Patent [19]

McCullough, Jr. et al.

[11] Patent Number: 4,869,951

[45] Date of Patent: Sep. 26, 1989

[54] METHOD AND MATERIALS FOR MANUFACTURE OF ANTI-STATIC CLOTH

[75] Inventors: Francis P. McCullough, Jr., Lake Jackson, Tex.; David M. Hall, Auburn, Ala.

[73] Assignee: The Dow Chemical Company, Midland, Mich.

[21] Appl. No.: 156,772

[22] Filed: Feb. 17, 1988

[51] Int. Cl.[4] ..... D02G 3/04; D02G 3/44; D03D 15/12; D04H 1/00

[52] U.S. Cl. ..... 428/229; 5/459; 5/483; 28/247; 57/254; 57/255; 57/901; 139/420 A; 428/288; 428/297; 428/362; 428/367; 428/408; 428/920

[58] Field of Search ..... 428/229, 288, 297, 362, 428/920; 57/901, 254; 139/420 A

[56] References Cited

U.S. PATENT DOCUMENTS 4,412,675 11/1983 Kubo .

*Primary Examiner*—James C. Cannon

*Attorney, Agent, or Firm*—John Lezdey; Joe R. Prieto

[57] ABSTRACT

A yarn which is a blend of from 98.01% by weight of a conventional textile fiber or filament and from 2 to about 0.09% by weight of a non-linear anti-static carbonaceous filament or fiber.

14 Claims, No Drawings

METHOD AND MATERIALS FOR MANUFACTURE OF ANTI-STATIC CLOTH

FIELD OF THE INVENTION

The present invention relates to a method and material for manufacturing anti-static cloth. More particularly the invention is concerned with cloth having incorporated therein non-linear anti-static carbonaceous fibers.

BACKGROUND OF THE INVENTION

Cloth is manufactured from yarns containing fibers of various deniers by textile weaving or knitting processes or by the nonwoven techniques from natural or synthetic textile fibers and/or filaments made into yarns of the desired denier by conventional yarn making process. The natural and synthetic fibers are delivered to the yarn marking process as staple fiber in bales or as continuous filament on cones. In the case of the staple fiber, the yarn maker practices a process of opening wherein the staple fiber of a lot of bales is blended, by taking a small portion of each bale of the lot and passing it through a blend operation until the entire lot has been uniformly blended. The lot may be re-blended or cross-blended one or more times to increase the uniformity of the mixture of the fibers thus insuring more uniform yarn properties, such as dye acceptance. Depending upon the ultimate use of the yarn, various treatments may be undertaken at blending, such as tinting for lot identification or application of lubricants and the like. Usually, the blended fibers are fed into a card to produce a card sliver having a more parallel orientation of the fibers. It is customary to combine sliver from several cards in a process called drawing where the sliver strands receive a high degree of parallel orientation of the fibers in the sliver. Conventionally three drawing steps are employed, namely, breakers drawing, intermediate drawing and finisher drawing. The size of the sliver diameter is reduced in the next step called roving which further parallels the fibers and adds a small amount of twist. The roving is then ring spun into yarn. Alternatively, the roving from drawing may be spun into yarn by an open end spinning process. The yarn size produced is dictated by the ultimate end use of the yarn, e.g., the fineness of the ultimate weave and/or knit fabric Of course when a continuous filament yarn is desired, several cones of the mono- or multi-filaments are used as received or may be twisted together to form the desired singles denier.

In both staple yarns and continuous filament yarn, if a ply yarn is desired, the usual custom is to twist two singles of yarn in a reverse twist to the singles twist to make the final denier or count of the yarn for knitting and/or weaving the cloth of the desired structure and weight.

The final treatment of the cloth is a series of washings, dyeing and pressing to finish the cloth for its ultimate use in clothing, sheeting and the like.

Many items of clothing made from cloth prepared as above described are worn by persons working in professions and arts where it is desirable or necessary to reduce the areas as the computer industry, both manufacture and use, it is desirable to reduce the accumulation of static charges on the cloth or person to a very low value to prevent glitches occurring in the circuitry resulting from the static discharge from the cloth of the wearer to the computer component and/or the computer per se. Current technology employs an organic polymer composite fiber, such as a nylon composite fiber, which is either a hollow fiber filled with a graphite paste or a fiber having a carbonaceous sheath about the exterior of the fiber. In either case, the resulting fibers, while electroconductive with respect to static-electrical dissipation, is of a larger than normal denier, that is, they have fiber diameters in the range of 20 to 50 microns, and may show up to the naked eye in the finished cloth. Further, the static dissipating fibers are not dyeable to the same degree as the other textile fibers with which they are blended and even in very dark fabrics may be noticeable.

While it may seem obvious to employ conventional carbon or graphite fibers it has been found that they are not suitable substitutes for the core or sheath yarns, since these carbon/graphite fibers or filaments having been carbonized at above about 1000° C. are too brittle and break into such short staple during the yarn making process so that little or no static dissipating properties remain from their presence in the yarn.

It would therefore be advantageous for the cloth to be made static resistant and have electrical charge dissipating properties by incorporating into the cloth as a component of the yarn a finer denier, 7 to 20 microns, carbonaceous fiber having properties suitable for incorporation into the yarn per se during the yarn making process.

BRIEF DESCRIPTION OF THE INVENTION

In accordance with the present invention a static electrical dissipating effect is obtained in cloth made from knitting or weaving staple or continuous yarns by incorporating into the yarn a staple anti-static fiber or continuous anti-static filament. That is, carbonaceous filaments or fibers prepared from a stabilized petroleum or coal tar pitch or acrylic based spun filaments which have been provided with a permanent nonlinear (coil-like and/or sinusoidal) structural configuration imparted. The carbonaceous fibers besides being anti-static possess a flexible, resilient and elongatable and deflectable characteristics which enables the fibers or filaments to be processed into yarns or threads by conventional textile processing equipment. Such characteristics are imparted by one of several techniques, hereafter more fully explained, such as by knitting a tow of precursor filaments, heat treating the so-knit fabric at above about 550° C. to impart a substantially irreversible coil-like and/or sinusoidal configuration to the individual filaments and thereafter deknitting the fabric The resulting tow may be used per se by separating the filaments into individual tows of a smaller number or count of filaments or the filaments may be cut or chopped into staple length, usually of about 1 to 4 inches in length. The latter staple fibers may be incorporated into the yarn making process, most preferably at the bale opening process. However, the fibers could also be added as a sliver during drafting or any stage and in any amount, or a yarn may be made of the staple fibers in for example, as a one in ten to a one in twenty yarns in the weaving or knitting process to make the finished cloth or fabric.

The carbonaceous material useful in accordance with the present invention is more fully described in application Ser. No. 112,353, filed Oct. 22, 1987, entitled "Carbonaceous Fibers with Spring-like Reversible Deflection and Method of Manufacture", of Francis P. McCullough and David M. Hall, and now Pat. No. 4,837,076, which is incorporated in toto herein by reference.

The nonlinear structural configuration can also be imparted to the filaments by heating the precursor filaments while passing the through a gentle gear box crimp device conventionally used in the textile industry. The resulting structural configuration is somewhat sinusoidal in nature but has no sharp bends as one would expect from the conventional crimp set processes of the textile industry, such as stuffer box treatments.

In addition, the coil-like configuration can be achieved by winding the tow and a tapered mandrel and heating the precursor tow while moving it down the taper to insure the filaments are in a totally relaxed state to enable them to shrink as the temperature of treatment is raised.

The degree of anti-static dissipating characteristics is achieved as a result of the temperature to which the filaments are subjected. From about 555° C. to about 750° C. the conductivity is such as to dissipate static electrical charges. Above about 750° C electrical conductivity rises rapidly approaching metallic conductors but anti-static characteristics diminishes. present invention are nonflammable nonlinear elongatable fibers or filaments having a reversible deflection of greater than 1.2:1, preferably greater than 2.0:1 and an aspect ratio (1/d) greater than 10:1.

Further and in accordance with the present invention the fibers having a diameter of 7–20 microns which contribute the anti-static property to the threads and/or yarns of the present invention in a 6K tow have a resistance of about $10^7$–$10^4$ohms per inch, a density of less than 2.5 gm/cc and a surface area of less than 15 $m^2$/gm.

The invention resides in the use of a resilient carbonaceous anti-static fiber or fiber assembly derived from an oxidation stabilized carbon containing polymeric precursor material having imparted thereto a non-linear structure capable of reversible deflection of greater than about 1.2 times the length of the non-linear structure when in a relaxed condition. More particularly, the carbonaceous fiber or fiber assembly structure of the present invention is formed into a permanent, nonlinear, resilient, elongatable, non-linear structural configuration. The fibers or fiber assembly of the invention have no sharp or acute angular bends or configuration. The non-linear structure and the resilient, elongatable characteristics of the fiber or fiber assembly allows for a dimensional change of the non-linear structure from a relaxed spring-like configuration to an elongated, stretched, and a substantially linear state, or any degree there-in-between, in which the fiber or fiber assembly structure is under tension. When under tension, the non-linear configuration of the fiber or fiber assembly can be stretched to a length of at least 1.2 times, typically from 2–4 times, the length of the non-linear structure of its relaxed non-deflected state. The non-linear structure can thus be deflected (elongated or stretched) to a substantially linear state. If the modulus of elasticity of the fiber per se is not approached or exceeded, that is to say the fiber per se is not put under tension beyond that necessary to straighten the non-linear structure of the fiber or fiber assembly, the non-linear structure is capable of returning from the linear to its relaxed nonlinear or sinusoidal state over many cycles of stress elongation to the linear state without either breaking of the fiber or substantially altering the dimensions of the relaxed coil-like state.

The anti-static fibers of the invention may be blended with natural and/or synthetic fibers. The natural fibers may be selected from the group consisting of cotton, wool, flax, silk and mixtures thereof.

The synthetic fibers which may be utilized include cellulosic, polyester, polyolefin, aramide, acrylic fluoroplastic, polyamide, polyvinyl alcohol, and the like.

In accordance with a further embodiment of the invention, the anti-static fibers are prepared from a fiber, yarn or tow of oxidation stabilized precursor materials. The precursor materials may comprise acrylic filaments pitch based (petroleum or coal tar) filaments, polyacetylene or other polymeric materials. The precursor fibers may be formed by any conventional method, i.e., melt or wet spinning to a nominal diameter of from 10 to 20 micrometers, which is then stabilized by oxidation in a known manner The fibers may have a temporary set coil-like or sinusoidal configuration imparted when heated below 525° C. A substantially irreversible set is imparted when heated to at least a temperature and a period of time as will hereinafter characteristics are changed. The heating temperature, as will be hereinafter discussed, will provide the fibers with different degrees of electrical conductivity A preferred embodiment of the carbonaceous anti-static fibers or filaments employed in accordance with the present invention comprises nonlinear nonflammable resilient elongatable carbonaceous fibers or assembly of fibers having a reversible deflection greater than about 1.2:1 and an aspect ratio of greater than 10:1. The carbonaceous fibers may possess a sinusoidal or a coil-like configuration or a more complicated structural combination of the two.

The anti-static fibers of the invention according to the test method of ASTM D 2863-77 have an LOI value greater than 40.

Such carbonaceous fibers are prepared by heat treating a suitable stabilized precursor material such as that derived from stabilized polyacrylonitrile based materials or pitch base (petroleum or coal tar) or other polymeric materials which can be made into a nonlinear fiber or filament structure or configurations. The fibers have a carbon content of at least 65%. For example, in the case of polyacrylonitrile (PAN) based fiber, the fibers are formed by melt or wet spinning a suitable fluid of the precursor material into a fiber having a nominal diameter of from 4 to 25 micrometers. The fiber is collected as an assembly of a multiplicity of continuous filaments in tows which are stabilized (by oxidation in the case of PAN based fibers) in a conventional manner. Stabilized tows (or staple yarn made from chopped or stretch broken fiber staple) are thereafter, in accordance with the present invention, formed into a coil-like and/or sinusoidal form by knitting the tow or yarn forming and crimp or coil making methods can be employed). The so-formed knitted fabric or cloth is thereafter heat treated, in a relaxed and unstressed condition, at a temperature of from about 525° C. to about 750° C., in an inert atmosphere for a period of time to produce a heat induced thermoset reaction wherein additional cross-linking and/or cross-chain cyclization reaction occurs between the original polymer chain. At the lower temperature range of from about 150° C. to about 525° C., the fibers are provided with a varying proportion of temporary to permanent set while in the upper range of temperature of from 525° and above, the fibers are provided with a permanent set. It is of course to be understood that the fiber or fiber assembly may be initially heat treated at the higher range of temperature so long as the heat treatment is conducted while the coil-like and/or sinusoidal configuration is in a relaxed or unstressed state and under an inert, nonoxidizing atmosphere. As a result of the higher temperature treatment, a permanent set non-linear configuration or structure is imparted to the fibers in yarn, tow or threads. The resulting fibers, tows or yarns having the nonlinear structural configuration, which are derived by knitting the cloth, or even the cloth per se, are subjected to other methods of treatment known in the art to create an opening, a procedure in which the yarn, tow or the fibers or filaments of the cloth are separated into a nonlinear entangled wool-like fluffy material in which the individual fibers retain their coil-like or sinusoidal configuration while yielding a fluff or batting-like body of considerable loft.

The carbonaceous material used in the invention may be classified into three groups depending upon the particular use and the environment that the structures in which they are incorporated are placed.

In a first group, the linear nonflammable carbonaceous fibers are nonelectrically conductive and possess no substantial anti-static characteristics.

The term nonelectrically conductive as utilized in the present application relates to a resistance of greater then $10^7$ ohms per inch on a 6K tow formed from precursor fibers having a diameter of 10–20 microns.

In a second group, the nonflammable nonlinear carbonaceous fibers are classified as being anti-static, slightly electrically conductive and have a carbon content of less than 85%. Low conductivity means that a 6K tow with the fibers has a resistance of about $10^7$ to $10^4$ ohms per inch. When the precursor stabilized fiber is an acrylic fiber, i.e., a polyacrylonitrile based fiber, the nitrogen content is from about 10 to 35%, preferably from about 16 to 22%. The fibers can provide a fabric with static dissipating properties to 0% of the original charge in less than 2 seconds.

In a third group are fibers having a carbon content of at least 85%. These fibers are characterized as being highly electrically conductive. That is, the resistance is less than about $10^4$ ohms per inch.

It is the fibers of the second group which are critical for obtaining the anti-static characteristics in the invention. The fibers of the first and third groups may be utilized to form a base fabric structure where desired in combination with the fibers of the second group.

The precurson stabilized acrylic filaments which are advantageously utilized in preparing the fibers of the structure are selected from the group consisting of acrylonitrile homopolymers, acrylonitrile copolymers and terpolymers.

The copolymers and terpolymers preferably contain at least about mole percent of acrylic units, preferably acrylonitrile units, and up to 15 mole percent of one or more monovinyl units copolymerized with styrene, methylacrylate, methyl methacrylate, vinyl chloride, vinylidene chloride, vinyl pyridine, and the like. Also, the acrylic filaments may comprise terpolymers, preferably, wherein the acrylonitrile units are at least about 85 mole percent.

Preferred precursor materials are prepared by melt spinning or wet spinning the precursor materials in a known manner to yield a monofilament or multi-filament fiber tow, yarn, woven cloth or fabric or knitted cloth. The cloth or fabric is then heated preferably to a temperature above about 525° C. and thereafter deknitted. The tow resulting from the deknitting of the fabric may be used per se, more preferably, divided into an assembly of continuous filaments, or most preferably chopped, cut or stretch broken into staple fibers. The tow may be carded to produce a fluff which may be employed in the conventional yarn or thread making processes as afore described.

The invention provides a fabric having static dissipating properties to 0% of the original charge in less than 2 seconds. Advantageously the fabric comprises a yarn which is a blend of from about 98 to 99.01% by weight of a conventional textile fiber or filament and about 2 to 0.09% by weight of the non-linear carbonaceous filament or fiber having anti-static properties. The carbonaceous filament or fiber has a reversible deflection ratio of greater than 1.2:1 and an aspect ratio of greater than 10:1.

DETAILED DESCRIPTION OF THE INVENTION

In accordance with one embodiment of the present invention the fibers from bales of an undyed lot of conventional textile staple fibers, e.g. polyester, each fiber being approximately one and five-sixteenth (15/16) inches long, are introduced into an opening process by alternately feeding a small portion from separate bales of the fibers until all of the fibers of the lot have been blended.

In accordance with the present invention, a small portion of the anti-static carbonaceous fibers prepared in accordance with the present invention are also fed to the opening process. The carbonaceous fibers are prepared in accordance with the technique of aforementioned Ser. No. 112,353 which imparts to the tow filaments a nonlinear configuration. The resulting tow is chopped to provide staple lengths of about one and one-half (½) inches and added to an opening process in a ratio of about one part by weight per 200 parts by weight of polyester fibers. The resulting blended stock is carded and formed into a single sliver. This sliver is processed in a conventional three step drawing procedure. After drawing, the sliver is spun into a singles yarn on an open end frame. If desired two singles may be twisted together to form a yarn known as a two ply yarn. This yarn may be used in a conventional cloth or fabric manufacturing process to produce a cloth or fabric which has the desired static electric dissipating properties.

Exemplary of the present invention are set forth in the following examples wherein all percentages utilized are based on weight per cent.

EXAMPLE 1

Monsanto 1.5 denier polyester fiber, received in bales, was blended in an opening process with 0.2% by weight of an anti-static fiber. The fiber had been prepared by heating an oxidatively stabilized polyacrylonitrile multi-filament tow, knitting the same on a jersey knit machine, heat setting the knit fabric a+about 550° C., deknitting the fabric and chopping the tow into about 1.5 inch lengths, which were used in a blending-opening process. The blended stock from this opening process was carded and the resulting card sliver passed through drawing and finally spun on an open fame into a 25's/cotton count singles yarn. This singles yarn was twisted with another singles yarn to make a two ply yarn which was used to knit a sock about 12 inches in diameter. The resulting fabric when tested for static discharge properties by charging the fabric to 5000 volts while in an atmosphere having a relative humidity of less than 20%, dissipated the charge in less than two seconds

EXAMPLE 2

The same yarn as described in Example 1 was woven on a hand loom into a fabric having an 80 "×80" construction. Both warp and filling yarns contained the anti-static fiber. The resulting fabric when tested for static discharge properties by charging the fabric to 5000 volts while in an atmosphere having a relative humidity of less than 20%, dissipated the charge in less than two seconds.

EXAMPLE 3

A fabric was hand woven as in Example 2 employing the anti-static fiber containing yarn as the warp yarn only. The resulting fabric when tested for static discharge properties by charging the fabric to 5000 volts while in an atmosphere having a relative humidity of less than 20%, dissipated the charge in less than two seconds.

EXAMPLE 4

In still another experiment a fabric was woven in which every other warp yarn and every other fill yarn contained the anti-static fiber. The resulting fabric when tested for static discharge properties by charging the fabric to 5000 volts while in an atmosphere having a relative humidity of less than 20%, dissipated the charge in less than two seconds.

EXAMPLE 5

In another experiment, a fabric was woven which had every other warp yarn containing the anti-static fiber. The resulting fabric when tested for static discharge properties by charging the fabric to 5000 volts while in an atmosphere having a relative humidity of less than 20%, dissipated the charge in less than two seconds.

EXAMPLE 6

The anti-static fiber containing card sliver as described in Example 1 was passed through a Rando Webber to produce a non-woven bat. The bat was needle punched to provide integrity to the bat and tested as before. The resulting fabric when tested for static discharge properties by charging the fabric to 5000 volts while in an atmosphere having a relative humidity of less than 20%, dissipated the charge in less than two seconds.

EXAMPLE 7

Another batch was prepared as in Example 6 but 2% by weight of low melting polyethylene fibers were mixed with the carded stock then passed through the Rando Webber The resulting bat was passed through an oven heated to 150° C. The polyethylene fibers provided a sufficient cohesiveness to the bat to maintain the bat integrity after manual compression. The bat was needle punched to provide integrity to the bat and tested as before. The resulting fabric when tested for static discharge properties by charging the fabric to 5000 volts while in an atmosphere having a relative humidity of less than 20%, dissipated the charge in less than two seconds.

We claim:

1. A fabric having static dissipating properties to 0% of the charge in less than 2 seconds comprised of:

a yarn which is a blend of conventional textile fibers or filaments and at least about 0.09% by weight of nonlinear anti-static, heat treatment-produced carbonaceous filaments or fibers, said anti-static carbonaceous fibers having a reversible deflection ratio of greater than 1.2:1, a carbon content of at least 65% by weight, an electrical resistance in a 6K tow of about $10^7$ to $10^4$ ohms per inch, and an aspect ratio of greater than 10:1.

2. The fabric of claim 1, wherein said yarn comprises from about 0.09 to 2% by weight of said anti-static fiber.

3. The fabric of claim 1, wherein said carbonaceous fibers having a sinusoidal configuration.

4. The fabric of claim 1, wherein said carbonaceous fibers have a coil-like configuration.

5. The fabric of claim 1, wherein said carbonaceous fibers are derived from stabilized acrylic fibers.

6. The fabric of claim 5, wherein said carbonaceous fibers are derived from stabilized polyacrylonitrile fibers.

7. The fabric of claim 1, wherein said carbonaceous fibers are derived from pitch based fibers.

8. The fabric of claim 1, wherein said textile fibers are selected from the group consisting of cellulosic, polyester, polyolefin, aramide, acrylic, fluoroplastic, polyamide and polyvinyl alcohol fibers.

9. The fabric of claim 1, which is woven.

10. The fabric of claim 1, which is non-woven.

11. The fabric of claim 10, wherein said carbonaceous fiber has a sinusoidal configuration.

12. The fabric of claim 10, wherein said carbonaceous fiber has a coil-like configuration.

13. A method of producing a fabric wherein the improvement comprises imparting to the fabric a capacity to dissipate static to 0% of original static charge in less than 2 seconds by incorporating therein at the time of formation a yarn comprising a blend of a conventional textile fiber or filament and at least about 0.09% by weight of a non-linear anti-static, heat treatment-produced carbonaceous filament of fiber having a reversible deflection ratio of greater than 1.2:1, a carbon content of at least 65% by weight, an electrical resistance in a 6K tow of about $10^7$ to $10^4$ ohms per inch, and an aspect ratio of greater than 10:1.

14. The method of claim 13, wherein said yarn comprises from about 0.09 to 2% by weight of said anti-static fiber.

* * * * *

UNITED STATES PATENT AND TRADEMARK OFFICE

CERTIFICATE OF CORRECTION

PATENT NO. : 4,869,951

DATED : September 26, 1989

INVENTOR(S) : Francis P. McCullough, Jr. and David M. Hall

It is certified that error appears in the above-identified patent and that said Letters Patent is hereby corrected as shown below:

On the first page under the ABSTRACT, the first line, "98.01%" should read --98 to 99.01%--.

Column 1, line 64, "the areas" should read --the accumulation of static electricity on the cloth. In such areas--.

Column 2, line 62, "in" should read --in standard textile yarn making processes and the yarn used,--.

Column 3, line 25, "diminishes. present" should read --diminishes. The carbonaceous fibers or filaments employed in the present--.

Column 4, line 23 "hereinafter characteristics" should read --hereinafter be described whereby both the chemical and physical charactertics--.

Column 4, line 56 "yarn forming" should read --yarn into a fabric or cloth (recognizing that other fabric forming--.

Column 5, line 51, "precurson" should read --precursor--.

Column 6, line 26, "(15/16) should read --(1 5/16)--.

Column 6, line 61, "a+" should read --at--.

UNITED STATES PATENT AND TRADEMARK OFFICE

CERTIFICATE OF CORRECTION

PATENT NO. : 4,869,951

DATED : September 26, 1989

INVENTOR(S) : Francis P. McCullough, Jr. and David M. Hall

It is certified that error appears in the above-identified patent and that said Letters Patent is hereby corrected as shown below:

Column 7, line 59, "Webber The" should read --Webber. The--.

Signed and Sealed this

Thirtieth Day of October, 1990

*Attest:*

HARRY F. MANBECK, JR.

*Attesting Officer*

*Commissioner of Patents and Trademarks*